US005131650A

United States Patent [19]

Hall

[11] Patent Number: 5,131,650

[45] Date of Patent: Jul. 21, 1992

[54] EXERCISE DEVICE

[76] Inventor: Ellen P. Hall, 200 Park Central South, Suite 2, Pompano Beach, Fla. 33064

[21] Appl. No.: 633,355

[22] Filed: Dec. 27, 1990

[51] Int. Cl.[5] ..... A63B 21/02

[52] U.S. Cl. ..... 482/126; 482/122; 482/125; 482/139; 482/904

[58] Field of Search ..... 272/137, 142, 143, 900, 272/135, 136, 138, 139, 140, 141, 75

[56] References Cited

U.S. PATENT DOCUMENTS

| | | | |
|---|---|---|---|
| 3,985,354 | 10/1976 | Schulkin | 272/138 X |
| 4,019,734 | 4/1977 | Lee et al. | 272/137 |
| 4,057,246 | 11/1977 | Wilson | 272/137 |
| 4,059,265 | 11/1977 | Wieder et al. | 272/137 |
| 4,316,610 | 2/1982 | Hinds | 272/137 |
| 4,685,671 | 8/1987 | Hagerman et al. | 272/136 X |
| 4,779,867 | 10/1988 | Hinds | 272/137 |

*Primary Examiner*—Richard J. Apley
*Assistant Examiner*—Karen Richard

[57] ABSTRACT

An exercise device including an elongated exercise bar of non-circular cross-section having end members that include throughbores and a conical recess extending outwardly from the throughbore, and a slot communicating with the throughbore for permitting the lateral insertion into the throughbore of a tubular, elastic cable member. The elastic cable member includes one or more internally positioned plug members that provide local enlargement of the cable and are adapted to cooperte with the conical recess to securely position the cable with respect to the end member and to prevent the cable from passing through the end member when tension is applied to the cable. The free ends of each of the cables can be connected either with a stirrup having a similar cable retaining structure as at the ends of the exercise bar, or they can be connected with cable retaining members carried at the ends of a belt member that has an intermediate portion adapted to be connected with a stationary structural element to provide a fixed resistance to movement.

20 Claims, 3 Drawing Sheets

EXERCISE DEVICE

BACKGROUND OF THE INVENTION

1. Field of the Invention

The present invention relates to a portable exercise device for exercising various body muscles. More particularly the invention relates to a portable exercise device that includes an elongated bar member and a pair of stirrups that are connectable with the bar member by an elastic cable that is releasably connected with the ends of the bar member. Additionally, the device includes a separate retaining structure to permit a fixed connection with a stationary object, to enable a broad range of exercises to be performed by securing the retaining structure to the stationary object and pulling or pushing on either the bar member or the stirrups.

2. Description of the Related Art

Many different types of exercise devices have been developed over the years, some of which include various types of stands or tables that are not readily portable and that are adapted to be used in a single location. Other known devices are of a portable nature and involve various types of straps and elastic and rigid members to permit the device to be used wherever the user happens to be and to be easily transported from place to place.

One example of a portable exercise device is disclosed in U.S. Pat. No. 4,779,867, which issued Oct. 25, 1988, to Robert S. Hinds. The device disclosed in that patent includes an elastic cable that can be connected to stirrups and to a bar member or to a door attachment device, to permit a number of different exercises to be performed by a user. However, the Hinds patent discloses a device that includes a single elastic cable, the ends of which can be connected to stirrups and the intermediate portion of which can be received in yokes formed at the ends of an elongated exercise bar, the bar having a longitudinal slot or groove formed in one surface to receive the length of cable that extends over the bar and between the two ends of the bar. Although the Hinds device is reasonably adapted to the intended purpose, it involves excessively complex structural elements, including a complicated bar structure.

It is an object of the present invention to overcome the shortcomings of the prior art portable exercise devices.

It is a further object of the present invention to provide a simplified portable exercise device that is both effective as well as inexpensive to manufacture.

It is a still further object of the present invention to provide a portable exercise device that includes elastic cables that can be adjusted so that the effective lengths of the elastic cables can be varied to suit the physical characteristics of the user.

SUMMARY OF THE INVENTION

Briefly stated, in accordance with one aspect of the present invention, a portable exercise device is provided that includes an elongated hollow bar having openings at each longitudinal end. The bar is preferably of non-circular cross section and includes a bar plug member inserted into each of the end openings. The bar plug member includes an insertion end that is received within the end of the bar, and a loop connected to the insertion end and extending outwardly from the insertion end when the plug member is inserted into the bar. The loop is discontinuous and includes a slot into which an elastic tubular cable can be laterally inserted. Cable plug members are provided and are adapted to be received within and frictionally held within the tubular cable at locations selected by the user in order to adapt the effective operating length of the cable to the particular user's physical characteristics. A suitable fixing arrangement is provided for fixing in position the free ends of the cables, to permit the cables to be stretched by a user's pulling or pushing on the bar.

In accordance with another aspect of the present invention, the fixing means can include a pair of stirrups, each of which is connected with the free end of each cable to permit the use of the device by inserting either the hands or feet of the user into the stirrups and then using the other of the hands or the feet to either restrain or to pull on the bar.

In accordance with still another aspect of the present invention, the fixing means can include a belt having cable retainers at each end, the belt including an enlarged block or other device for permitting a portion of the belt to be inserted between a door and a door jamb, to provide a fixed connection for one end of each of the elastic cables.

DESCRIPTION OF THE PREFERRED EMBODIMENTS

Figure 1:
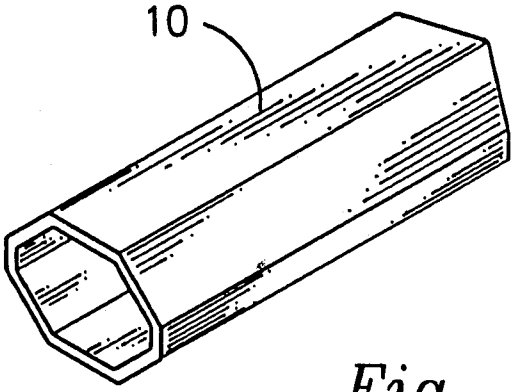
FIG. 1 is a fragmentary perspective view showing an exercise bar in accordance with the present invention.

Referring now to the drawings, and particularly to FIG. 1 thereof, there is shown an elongated, hollow exercise bar 10 that is of non-circular, octagonal cross section. Bar 10 can have a cross-sectional circumference of approximately five inches or so for ease of gripping, and can have a length of about twenty-five inches. As will be appreciated by those skilled in the art, bar 10 can be any convenient size, the dimensions given herein being for illustrative purposes only. Bar 10 is preferably made from a rigid material, such as extruded aluminum or from extruded, rigid structural plastic for strength.

Figure 2:
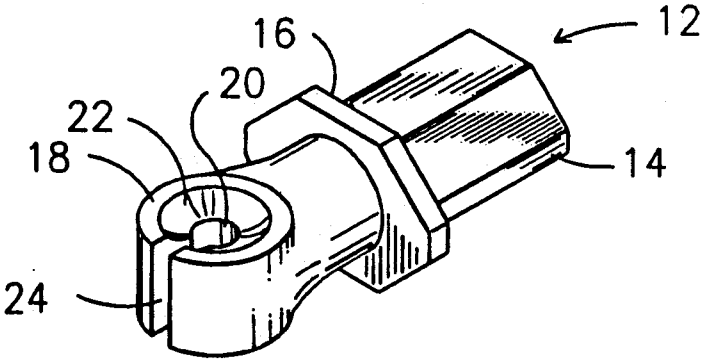
FIG. 2 is a perspective view of a combined end plug and cable retainer that is adapted to be inserted into the open ends of the exercise bar shown in FIG. 1.

Bar plug members 12 of the type shown in FIG. 2 are inserted into each of the open ends of exercise bar 10. As shown, plug member 12 includes a blade portion 14 that has the same cross-sectional configuration as that of exercise bar 10, so that it can be snugly received within the end of the bar. Plug member 12 is also preferably made from a rigid material to withstand the stresses imposed by a user while exercising.

A flange member 16 extends around blade portion 14 inwardly of the outer end thereof and is adapted to overlie the end cross-section of bar 10. A socket member 18 extends outwardly from flange member 16 and is adapted to receive and retain a tubular elastic cable. Socket member 18 is in the form of a loop to receive an elastic cable and includes a throughbore 20 and an inwardly dished conical recess 22 that extends from the lateral surface of the loop inwardly to intersect with bore 20. A recess 22 is formed on at least one lateral surface of the loop to serve as a retainer for the elastic cable, but a recess can also be formed on the opposite lateral surface thereof, if desired, so that a tubular cable can be inserted with an inner plug on either lateral side of plug member 12. Socket member 18 includes a slot 24 that extends inwardly to throughbore 20 to permit the tubular cable to be passed through the slot and into the throughbore. Preferably, slot 24 has a width that is less than the diameter of throughbore 20 in order to retain the tubular cable within socket member 18.

Figure 3:
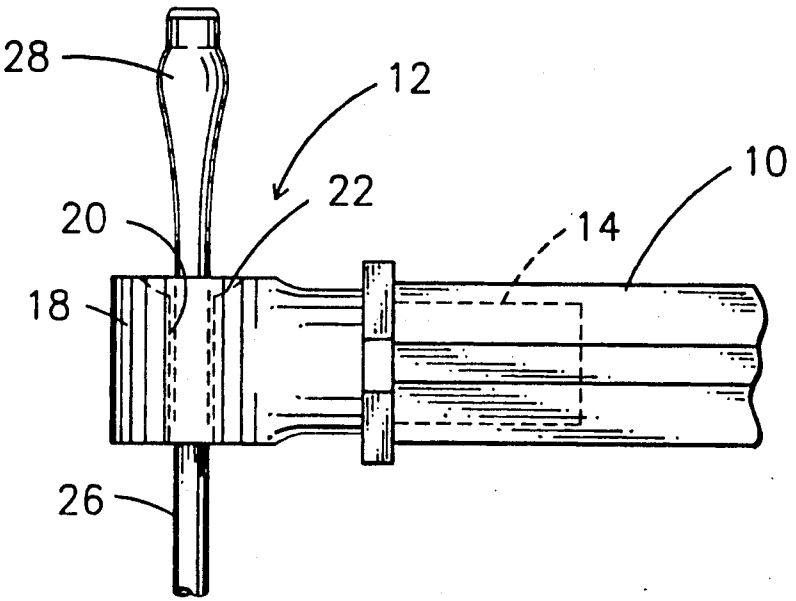
FIG. 3 is a fragmentary side view showing an end plug and cable retainer installed in an exercise bar in accordance with the present invention, and an elastic cable positioned in the end plug.
Figure 4:
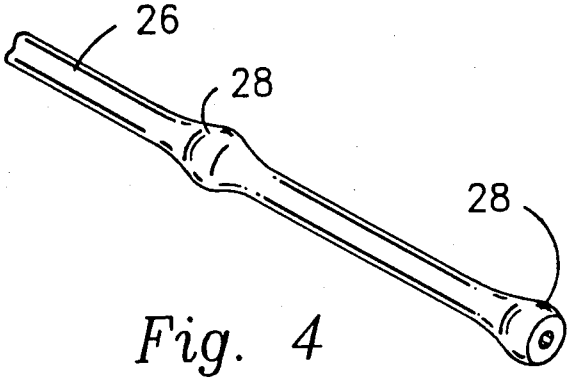
FIG. 4 is a perspective view of an elastic cable including a plurality of plug members positioned at various points along the length of the cable.

The assembly of plug member 12 into bar 10 is shown in FIG. 3, which also shows a tubular cable 26 extending through throughbore 20 of plug member 12. Cable 26 includes an enlarged thickness section 28 that is provided by inserting a cable plug member into cable 26. As shown in FIG. 4, tubular cable 26, which can have a length of approximately thirty-six inches, can include a plurality of plug members inserted therealong, to provide several spaced enlarged thickness portions 28, which can be used to adapt the invention for different exercises and for different sized users, as will be hereinafter explained in greater detail.

Figure 5:
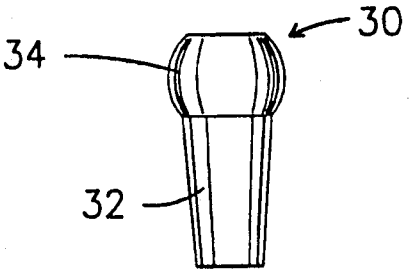
FIG. 5 is a side elevational view showing one form of plug member that is adapted to be positioned within the tubular cable.
Figure 6:
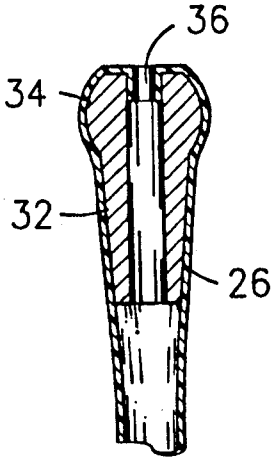
FIG. 6 is a fragmentary cross-sectional view showing a plug member as shown in FIG. 5, with a tubular elastic cable in position thereon with the end of the cable tucked into a bore formed at one end of the plug.

Referring now to FIGS. 5 and 6, there is shown a cable plug member 30 of a type adapted for insertion into a tubular cable. Cable plug member 30 includes an elongated, tapered body portion 32 and an enlarged, bulbous end 34 having a greater transverse dimension than that of body portion 32. Preferably, plug member 30 has a circular cross section throughout its length, although other cross sections can also be employed, if desired. When inserted into an elastic tubular cable, the plug member, the bulbous end of which has a greater outer diameter than the inner diameter of the cable, causes a portion of the wall of the tubular cable to bulge outwardly, as at 28. Additionally, because cable plug member 30 includes an inner bore 36, defining an inner recessed portion, a cable plug member 30 that is inserted adjacent an end of tubular cable 26 can have the end portion of the cable tucked into bore 36 to avoid a loose cable end.

Figure 7:
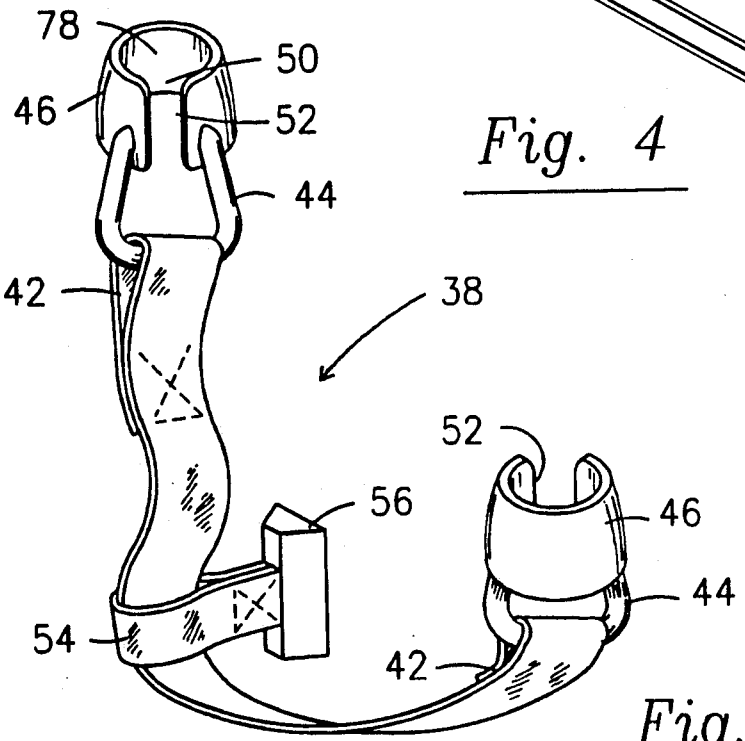
FIG. 7 is a perspective view showing one form of fixing device for connection with a rigid structure and including a belt having a pair of cable retainers at each end for connection with a tubular elastic cable.

After one of the ends of each of two tubular cables has been inserted into a respective plug member 12 in an exercise bar 10, the free ends of each of the cables can be connected to a fixing means, to fix the free ends of the cable in position so that the exercise bar can be pulled for exercising various body muscles. As shown in FIG. 7, one form of fixing means 38 is in the form of a belt 40, which can be a woven nylon belt, or the like, that includes loop members 42 at each end, loop members 42 passing through cable retaining members 44. Preferably, cable retainer members 44 have an end 46 with an inner configuration similar to that of bar end plug members 12 in that they have a substantially conical inner recess 48, a throughbore 50 that extends through ends 46, and a longitudinal slot 52 to permit insertion of a tubular cable member into retainer member 44 so that a cable including an inner cable plug member 30 can be retained in cable retaining member 44.

Belt 40 includes a slidable loop member 54 that can carry a block 56 or other enlargement, to permit loop member 54 to be positioned between a door and a door frame (not shown) with block or enlargement 56 serving as a stop to hold loop member 54 and keep it from passing completely through the space between the door and the door frame. In that position, belt 40 and its associated structure as shown in FIG. 7 is rigidly retained by the door and door frame, and thus it permits exercises to be performed by pulling on exercise bar 10 after the free ends of the respective cables have been inserted into the respective cable retainer members 12 at the ends of the bar.

Figure 8:
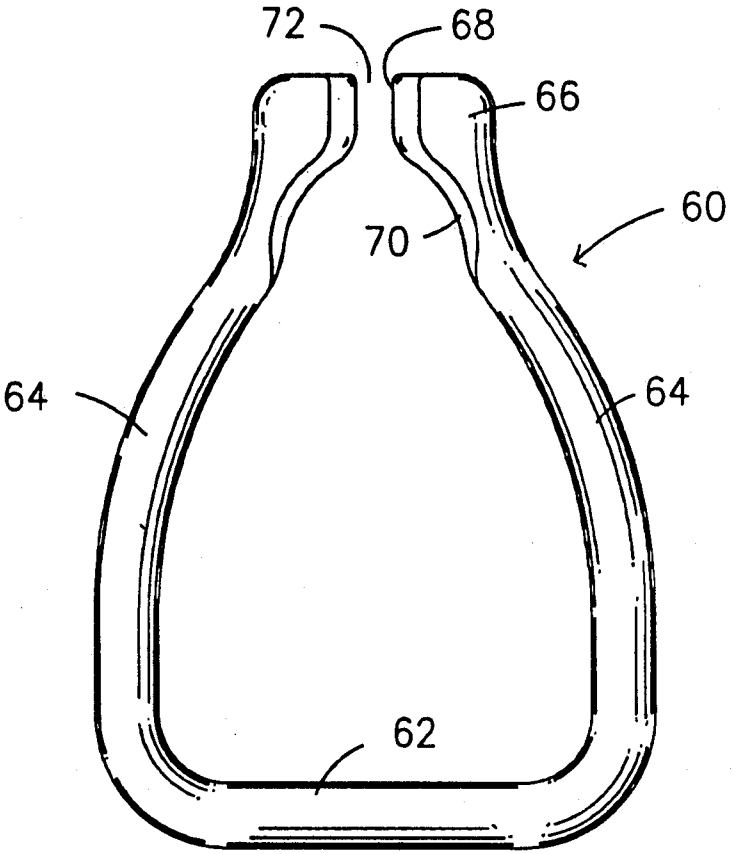
FIG. 8 is an elevational view of a stirrup that can be used with the present invention and including a centrally positioned cable retainer.

Another form of fixing means for attachment to the free ends of the cables that are carried by exercise bar 10 is a stirrup 60 as shown in FIG. 8. Stirrup 60 has a straight base member 62 and a pair of converging legs 64 extending upwardly from each end of base member 62 to terminate at a stirrup connection 66. Connection 66 is preferably of the same configuration as bar plug member 12 carried at the ends of exercise bar 10 and shown in FIG. 2, and the same configuration as that of retainers 44 carried by belt 40 as shown in FIG. 7. More specifically, a throughbore 68 is provided at connection 66, throughbore 68 communicating with a conical seat portion 70 that is adapted to engage with a cable having a cable plug member 30 installed therein so that the body portion 32 of the plug member extends into throughbore 68 and bulbous end 34 engages and is retained in conical seat portion 70. A longitudinally extending slot 72 is provided to permit the cable to be inserted laterally into connection 66. When a stirrup 60 is installed at each of the free ends of the cable, the device can be utilized in many different ways to exercise leg or arm muscles.

Figure 10:
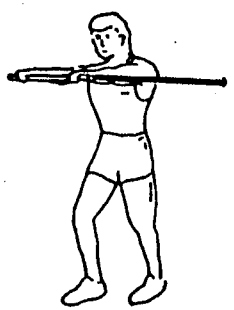
FIGS. 9 through 12 show various ways in which the present invention can be used for exercising.
Figure 9:
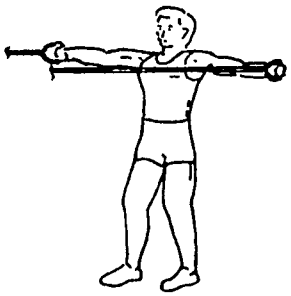
Figure 11:
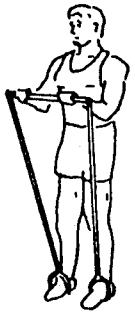

Some of the ways the present invention can be used for exercise purposes are shown in FIGS. 9 through 12. In FIGS. 9 and 10, the fixing means illustrated in FIG. 7 (but not shown in FIGS. 9 and 10) has been installed between a door and a door frame, and ends of the cables are attached to the retainer ends of the belt. In FIG. 9, the free ends of the cables are attached to stirrups, to permit the stirrups to be gripped by the hands of the user for exercising arm and chest muscles. In FIG. 10, the free ends of the cables are attached to the ends of the exercise bar for either pushing or pulling exercises.

When the stirrups are used as the fixing means and the cables are interconnected between the stirrups and the exercise bar, the invention can be used for pulling, arm-type exercises as shown in Figure wherein the stirrups are positioned at the feet and the bar is manipulated by the hands and arms of the user.

Figure 12:
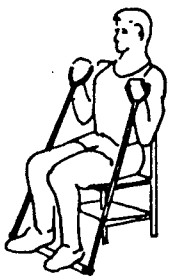

Another way to use the present invention is illustrated in FIG. 12, in which the stirrups are held in the hands, and the feet are used to hold the exercise bar against the ground, to permit arm curls to be performed, either in a sitting position as shown, or in a standing position, depending upon the points along the cable at which the connections are made to the stirrups and exercise bar.

It can thus be seen that the present invention provides an improved and simplified structural arrangement for an exercise device, permitting a wide variety of exercises to be performed by apparatus that is readily portable and easy to use. Although several different types of exercises have been illustrated, many more can be performed, thereby rendering the present invention adaptable to exercising a large number of body muscles.

Although particular embodiments of the present invention have been illustrated and described, it will be apparent to those skilled in the art that various changes and modifications can be made without departing from the spirit of the present invention. It is therefore intended to encompass within the appended claims all such changes and modifications that fall within the scope of the present invention.

What is claimed is:

1. An exercise device comprising:

a) an elongated bar having end openings at each longitudinal end thereof;

b) bar plug members insertable into the end openings of the bar, the plug members including an insertion end and a loop connected to the insertion end and extending outwardly from the end of the bar when the plug member is in position in the bar;

c) an elastic, tubular cable member whereby the tubular cable member may then be held within the loop of the bar plug member;

d) cable plug members adapted to be received within and frictionally held within the tubular cable member; and e) fixing means for fixing in position the free ends of the cable, to permit the cables to be stretched by a user's pulling or pushing on the bar.

2. An exercise device as claimed in claim 1 wherein the bar is of non-circular cross-section.

3. An exercise device as claimed in claim 2 wherein the bar has an octagonal cross-section.

4. An exercise device as claimed in claim 2 wherein the bar is hollow.

5. An exercise device as claimed in claim 1, wherein the loop of the bar plug member has a frustoconical inner surface and a through bore extending from the frustoconical inner surface through the loop member.

6. An exercise device as claimed in claim 5 wherein the loop is discontinuous.

7. An exercise device as claimed in claim 6 wherein the loop includes a narrow, open slot extending from the outer periphery of the loop to the through bore.

8. An exercise device as claimed in claim 7 wherein the slot is aligned with the bar longitudinal axis.

9. An exercise device as claimed in claim 1 wherein the plug member includes an outwardly extending flange between the insertion end and the loop to define a stop to limit inward movement of the insertion end into the bar end opening.

10. An exercise device as claimed in claim 1 wherein the cable plug members include an elongated body portion and a bulbous end at one end of the body portion.

11. An exercise device as claimed in claim 10 wherein the body portion is tapered.

12. An exercise device as claimed in claim 11 wherein the cable plug member has a circular cross-section along its entire length.

13. An exercise device as claimed in claim 10 wherein the bulbous end is spherical.

14. An exercise device as claimed in claim 1 wherein the fixing means includes a stirrup on each free end of the tubular cable.

15. An exercise device as claimed in claim 14 wherein the stirrup includes a connection means that defines a conical recess adapted to receive the cable having a cable plug member positioned within the cable, the cable plug member engagable with the recess to prevent movement of the cable in one longitudinal direction through the stirrup.

16. An exercise device as claimed in claim 15, wherein the loop is discontinuous.

17. An exercise device as claimed in claim 16 wherein the loop includes an open slot to permit lateral insertion into the bore of the tubular cable.

18. An exercise device in accordance with claim 1 wherein the fixing means includes a belt member having a pair of spaced ends, each end including first connecting means for connecting the cable end to each belt end; and stopper means carried by the belt member for engagement with a fixed body to secure the device to the fixed body and provide resistance to stretching of the cables.

19. An exercise device as claimed in claim 18 wherein the stopper means includes an end member and a thin connecting member connecting the end member with the belt member, the thin connecting member adapted to be position between a door and a door frame.

20. An exercise device as claimed in claim 18 wherein the stopper means is carried by the belt for sliding movement along the belt.

* * * * *